US009861845B2

(12) United States Patent
Reimer

(10) Patent No.: US 9,861,845 B2
(45) Date of Patent: Jan. 9, 2018

(54) COMBUSTIBLE FIRE SUPPRESSANT AEROSOL COMPOSITION

(71) Applicant: Goodrich Corporation, Charlotte, NC (US)

(72) Inventor: Karl G. Reimer, Fairfield, CA (US)

(73) Assignee: GOODRICH CORPORATION, Charlotte, NC (US)

( * ) Notice: Subject to any disclaimer, the term of this patent is extended or adjusted under 35 U.S.C. 154(b) by 180 days.

(21) Appl. No.: 14/515,830

(22) Filed: Oct. 16, 2014

(65) Prior Publication Data

US 2016/0107012 A1 Apr. 21, 2016

(51) Int. Cl.
*A62C 5/00* (2006.01)
*A62D 1/06* (2006.01)

(52) U.S. Cl.
CPC ..... *A62C 5/006* (2013.01); *A62D 1/06* (2013.01)

(58) Field of Classification Search
None
See application file for complete search history.

(56) References Cited

U.S. PATENT DOCUMENTS 2,275,032 A * 3/1942 Greider ..... C04B 28/105 106/286.6
3,468,839 A * 9/1969 Millane ..... C08K 3/26 260/998.19
5,240,692 A * 8/1993 Morifuji ..... C01F 5/24 423/430
5,861,106 A 1/1999 Olander
7,407,598 B2 8/2008 Posson et al.
7,906,034 B2 * 3/2011 Posson ..... A62D 1/06 149/109.2
8,182,711 B2 5/2012 Posson et al.
9,199,108 B2 12/2015 Guo et al.
2005/0129606 A1 * 6/2005 Mitsuhashi ..... A01N 25/08 423/430

(Continued)

FOREIGN PATENT DOCUMENTS

EP 2617473 A1 7/2013

OTHER PUBLICATIONS

Search Report regarding related EP App. No. 17161644.4; dated Aug. 16, 2017; 9 pgs.

*Primary Examiner* — Joseph D Anthony
(74) *Attorney, Agent, or Firm* — Cantor Colburn LLP

(57) ABSTRACT

A composition is disclosed including an oxidizer represented by the formula $M^1(X^1O_y)_z$, wherein $M^1$ is selected from a Group IA atom, and Group IIA atom, and a Group IIIA atom, X is selected from the group consisting of Cl, Br, I, y is 1-4, and z is 1-3, a fuel, and a hydrated salt or a combination of 2 or more hydrated salts having a dehydration decomposition temperature of greater than 200° C., represented by the formula $(M^2)_k(M^3)_m(X^2)_n(X_3)_o.(H_2O)_p$, where $M^2$ is selected from a Group IA atom, Group IIA atom, Group IIIA atom, $M^3$ is selected from a Group IIA atom, Group IIIA, and a transition atom, $X^2$ is a hydroxyl anion, $X^3$ is a carbonate anion, k, m, n, and o are each independently integers that balance the charges of $M^2$, $M^3$, $X^2$, and $X^3$ and p is a number greater than or equal to 1.

15 Claims, 1 Drawing Sheet

(56) References Cited

U.S. PATENT DOCUMENTS

| | | | | |
|---|---|---|---|---|
| 2005/0242319 | A1* | 11/2005 | Posson | A62D 1/06 252/2 |
| 2008/0245537 | A1* | 10/2008 | Posson | A62D 1/06 169/44 |
| 2011/0155943 | A1* | 6/2011 | Posson | A62D 1/06 252/3 |
| 2012/0273714 | A1* | 11/2012 | Guo | C09K 5/18 252/76 |
| 2015/0044469 | A1 | 2/2015 | Lorgouilloux et al. | |

* cited by examiner

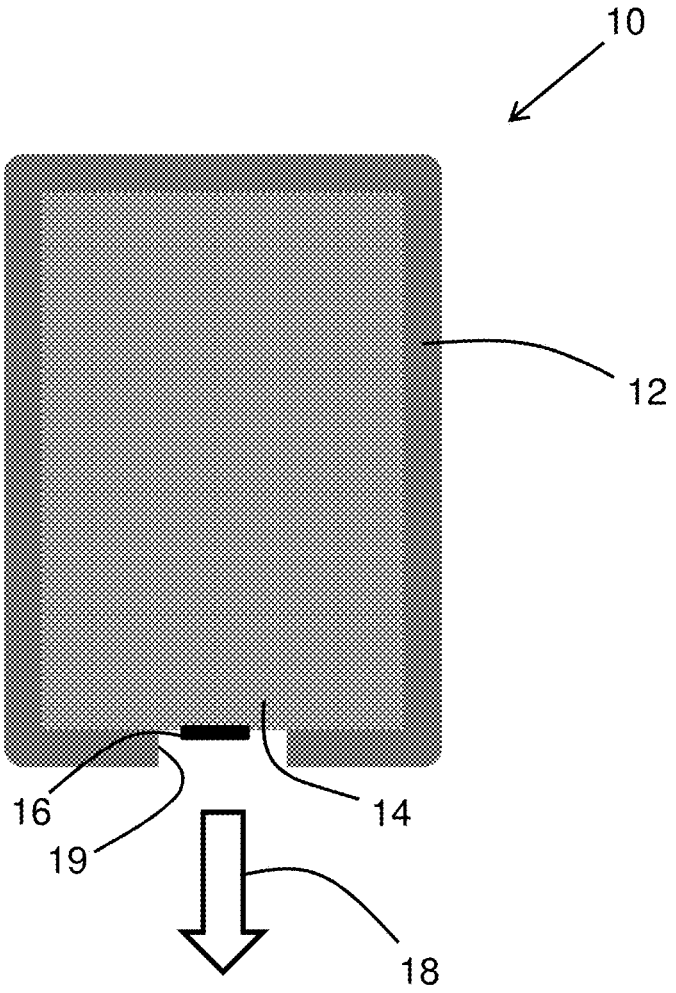
10
12
16
19
14
18

COMBUSTIBLE FIRE SUPPRESSANT AEROSOL COMPOSITION

BACKGROUND OF THE INVENTION

This invention relates to fire suppression compositions in general, and more specifically to combustible fire suppressant aerosol compositions.

Flame suppressants can be classified as either active (chemical) or passive (physical) suppressants. Active suppression agents react chemically with and destroy free radicals in the flame. Free radicals are very short-lived species that catalyze flame reactions, and their chemical removal or modification in turn suppresses the flame. Passive suppressants often seek to deprive the combusting fuel from oxygen by physically interfering from its transport to or access to the flame combusting fuel.

One form of active suppressant is a class of materials sold as Halon™, which are composed of brominated or chlorinated fluorocarbon compounds, e.g., bromochlorodifluoromethane ($CF_2BrCl$) and trifluorobromomethane ($CF_3Br$). These and competitive materials using similar chemistry have been used effectively as fire suppression agents for years, typically to protect electrical equipment since there is very little residue to clean up. These fire suppression agents typically interrupt the chemical reaction that takes place when fuels burn and depend on a combination of chemical effectiveness, e.g., quenching of free radicals, and some physical effectiveness, e.g., cooling the combustion flame and dilution of the combustion ingredients. Certain halogen-containing fire suppression agents, however, such as $CF_3Br$, contribute to the destruction of stratospheric ozone. Although the materials are essentially nontoxic, passage through a flame or over hot surfaces can produces toxic fluorine compounds.

To reduce the environmental effects associated with halogenated fluorocarbons, many commercially available fire suppression agents designed today are passive, i.e., physically acting, agents. A passive suppressant does not react chemically with the flame. These fire suppression agents either blanket the burning material to deprive it of oxygen, or they dilute the oxygen in the environment to below the point that can sustain the flame, or they cool the burning surface below its ignition temperature. Examples of physically-acting fire suppression agents include sodium bicarbonate and sand as well as inert gases, e.g., carbon dioxide ($CO_2$), water vapor ($H_2O$), and nitrogen ($N_2$). When applied to a fire, inert gases physically displace oxygen from the combustion region while simultaneously serving as a heat sink to reduce the temperature of the flame. The combination of the two physical actions results in suppression of the fire. Gaseous passive agents cannot be used as total flooding agents in occupied spaces because they must reduce the oxygen content below the amount that will sustain life. This is especially true for carbon dioxide because it also interferes with human respiration in addition to simple localized dilution of oxygen.

Physically-acting fire suppression agents are subject to certain issues and problems that can reduce their effectiveness at fire suppression. They typically a require large quantity of a physically-acting fire suppressant in order to suppress a fire and, consequently, equipment and storage must be large to accommodate the large quantity. Such large equipment is a disadvantage in limited spaces. Another disadvantage of physical suppressants is that they must often be applied to directly to a combusting surface, which can inhibit their effectiveness against fires that are concealed or relatively inaccessible.

An alternative to the above suppressant agent systems is the use of a pyrotechnically-generated aerosol flame free radical suppressant. This generation method may provide particles of free radical suppressant materials of such small particle size that their free-fall velocity is less than the velocity of air currents in an enclosed space. As such, the particles stay suspended, and seek out even concealed fires such as those that might be found inside enclosed spaces such as aircraft cargo subcontainers (e.g., an LD-3 container used on commercial aircraft). The smoke-like suspension characteristics of the aerosol provide long "hang times," referring to the length of time a single generator function can continue to suppress recurrent flame. Another benefit of such pyrochemically generated aerosol is that their ozone-depleting potential may approach zero, that their inhalation toxicity may be much lower than that of inert gas, and that no toxic irritant gases may be generated on passage through flame or with hot surfaces.

Unfortunately, existing combustible fire suppressant aerosols also experience a number of issues that can limit their effectiveness. For example, some combustible aerosol compositions have a limited operating temperature range of about 15.5° C. to about 35° C., and can fail to ignite at temperatures outside this range, or a product that ignites at higher temperatures will not ignite at lower temperatures, or a product that ignites at lower temperatures may not ignite or may combust too aggressively at higher temperatures. However, environments in which fire suppression systems are deployed can be subject to a much wider range of temperatures, such as from about −40° C. to about 71° C., thus limiting the effectiveness of combustible aerosol fire suppressants for many applications.

Prior attempts have suggested to cool the aerosol stream through the addition of solid carbonate or dicarboxylic acid salt coolants such as magnesium carbonate or magnesium oxalate in the combustion composition. However, these salts have very high decomposition temperatures, such as magnesium carbonate having a decomposition temperature of greater than 538° C. (1000° F.) and therefore acts only as an inert diluent below that temperature. Other prior attempts have suggested to cool the aerosol stream through the inclusion of hydrated magnesium oxalate or ettringite. However, these compounds release water and moisture at relatively low temperatures and will not allow the flame front to propagate resulting in poor ignition or again act as a diluent. For example, ettringite decomposes at less than 70° C. and about one third of the decomposition product is liquid water, and provides no cooling or temperature modulation benefits at many combustion temperatures across a wider range from as low as 260° C. (500° F.) where magnesium carbonate is ineffective to 538° C. (1000° F.), which includes much of the temperature range where combustion processes occur while.

BRIEF DESCRIPTION OF THE INVENTION

According to an aspect of the invention, a combustible fire suppressant aerosol composition comprises:

an oxidizer represented by the formula $M^1(X^1O_y)_z$, wherein $M^1$ is selected from a Group IA atom, a Group IIA atom, and a Group IIIA atom, X is selected from the group consisting of Cl, Br and I, y is 1-4, and z is 1-3;

a fuel; and a hydrated salt or a combination of 2 or more hydrated salts having a dehydration decomposition temperature of greater than 200° C., represented by the formula $(M^2)_k(M^3)_m(X^2)_n(X^3)_o.(H_2O)_p$, where $M^2$ is selected from a Group IA atom, Group IIA atom, Group IIIA atom, $M^3$ is selected from a Group IIA atom, Group IIIA, and a transition atom, $X^2$ is a hydroxyl anion, $X^3$ is a carbonate anion, k, m, n, and o are each independently integers that balance the charges of $M^2$, $M^3$, $X^2$, and $X^3$ and p is a number greater than or equal to 1.

According to another aspect of the invention, a method of discharging a combustible fire suppressant aerosol comprises:

combusting, either on a surface with no containment or in an enclosed vessel or vessels comprising at least one discharge opening, an oxidizer represented by the formula $M^1(X^1O_y)_z$, wherein $M^1$ is selected from a Group IA atom, and Group IIA atom, and a Group IIIA atom, X is selected from the group consisting of Cl, Br, I, y is 1-4, and z is 1-3, a fuel, and a hydrated salt or a combination of 2 or more hydrated salts having a dehydration decomposition temperature of greater than 200° C., represented by the formula $(M^2)_k(M^3)_m(X^2)_n(X^3)_o.(H_2O)_p$, where $M^2$ is selected from a Group IA atom, Group IIA atom, Group IIIA atom, $M^3$ is selected from a Group IIA atom, Group IIIA, and a transition atom, $X^2$ is a hydroxyl anion, $X^3$ is a carbonate anion, k, m, n, and o are each independently integers that balance the charges of $M^2$, $M^3$, $X^2$, and $X^3$ and p is a number greater than or equal to 1; and discharging from the combustion an aerosol comprising combustion gases and particulates produced by combustion of the composition.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying FIGURE, in which the FIGURE is a schematic depiction of an aerosol discharge device.

DETAILED DESCRIPTION OF THE INVENTION

As mentioned above, the combustible aerosol-generating composition (which is also referred to herein as simply an aerosol composition or combustible aerosol composition, even though the aerosol is technically not generated until combustion takes place) comprises an oxidizer represented by the formula $M^1(X^1O_y)_z$, wherein $M^1$ is selected from a Group IA atom, a Group IIA atom, and a Group IIIA atom, X is selected from the group consisting of Cl, Br and I, y is 1-4, and z is 1-3. In some embodiments, $M^1$ is a Group IA atom comprising lithium, sodium, or potassium. In some embodiments, $M^1$ is a Group IIA atom comprising strontium or magnesium. In some embodiments, $M^1$ is a Group IIIA metal such as aluminum. In a more specific embodiment, $M^1$ is sodium or potassium. In an even more specific embodiment, $M^1$ is potassium.

$XO_y$ can be a perhalate wherein y is 4; a halate wherein y is 3; or a halite or perhalate wherein x is 2. Examples of $XO_y$ include chlorates, bromates, iodates, perchlorates, periodates, chlorites, or mixtures thereof. In a more specific embodiment, In some embodiments, $XO_y$ is a bromate.

In some embodiments, the oxidizer is present in the composition in an amount of about 45 wt. % to about 90 wt. % based on the total weight of the aerosol-generating composition (unless stated otherwise, all weight percent values herein are based on the total weight of the aerosol-generating composition). In some more specific embodiments, the oxidizer is present in the composition in an amount of about 51 wt. % to about 88 wt. %, and even more specifically from about 57 wt. % to about 86 wt. %.

The oxidizers used in the aerosol compositions are typically strong oxidizers. In some embodiments, a suppressive halide salt, such as a Group IA, Group IIA or a Group IIIA halide salt, may be added to the composition, which salt can vaporize and recondense in the cooler regions of the reaction, thus increasing the suppressive power of the aerosol and decreasing the composition burning temperature and rate. Typically, the suppressive halide salt is present between about 0.1 to about 20 weight percent, more specifically between about 1 to about 15 weight percent. In another embodiment, the suppressive halide salt is present between about 1 to about 10 weight percent.

Examples of oxidizers used in the aerosol compositions include lithium nitrate, sodium nitrate, potassium nitrate, aluminum nitrate, lithium chlorate, sodium chlorate, potassium chlorate, lithium bromate, sodium bromate, potassium bromate, lithium iodate, sodium iodate, potassium iodate, aluminum iodate, lithium perchlorate, sodium perchlorate, potassium perchlorate, aluminum perchlorate, lithium periodate, sodium periodate, potassium periodate, aluminum periodate, lithium chlorite, sodium chlorite, potassium chlorite, aluminum chlorite, lithium bromite, sodium bromite, or mixtures thereof. In some embodiments, the oxidizers are selected from sodium bromate, potassium bromate, potassium nitrate, sodium nitrate, or mixtures thereof. In some embodiments, the oxidizers are selected from potassium bromate or sodium bromate. Mixtures of these oxidizers can be used to control the rate of burning. For example, potassium nitrate or sodium nitrate may be substituted for a portion of potassium bromate to decrease the rate of burning, as well as cost. In some embodiments, the aerosol composition comprises potassium bromate or sodium bromate as the principal oxidizer.

The fuel component includes, but is not limited to, melamine cyanurate, salts of cyanuric acid, isocyanuric acid, barbituric acid, hydroxyacetic acid, and mixtures thereof. Other fuel components like carbon black can also be included. The fuel component may also be a salt of other organic acids, including salts of hydroxy alkanedioic acids of a $C_{3-7}$ alkane, e.g., tartaric acid. Organic salts used as fuel in the aerosol composition can be Group IA or Group IIA salts. Thus, examples of organic salts use in the compositions of the present invention include, but are not limited to, lithium cyanurate, sodium cyanurate, potassium cyanurate, magnesium cyanurate, lithium isocyanurate, sodium cyanurate, potassium cyanurate, magnesium cyanurate, lithium barbiturate, sodium barbiturate, potassium barbiturate, magnesium barbiturate, lithium hydroxyacetate, sodium hydroxyacetate, potassium hydroxyacetate, magnesium hydroxyacetate, lithium tartrate, sodium tartrate, potassium tartrate, magnesium tartrate, or mixtures thereof. In some more specific embodiments, the organic salt comprises potassium cyanurate, magnesium cyanurate, potassium tartrate, magnesium tartrate, or mixtures thereof.

In some embodiments, the fuel is present in the composition in an amount of about 6 wt. % to about 40 wt. % based on the total weight of the aerosol-generating composition. In some more specific embodiments, the fuel is present in the composition in an amount of about 8 wt. % to about 35 wt. %, and even more specifically from about 10 wt. % to about 30 wt. %.

Compositions comprising a 1:1 weight ratio of oxidizer to fuel component, such as, for example, potassium bromate and magnesium tartrate, burn rapidly, but produce considerable residue. It has been discovered that compositions comprising a higher weight amount of oxidizer compared to the organic salt component burn rapidly and cleaner, with a lower amount of inorganic residue. In some embodiments, the oxidizer is present in a greater amount than the fuel. Accordingly, the weight ratio of oxidizer to fuel can be greater than about 1:1, allowing for a cleaner burning composition. In some embodiments, the weight ratio of oxidizer to fuel is from about 3:2 to about 5:1. In some embodiments, the weight ratio of oxidizer to fuel is from about 4:1 to about 10:1.

As mentioned above, the aerosol composition also comprises a hydrated salt having a dehydration decomposition temperature greater than 200° C., represented by the formula $(M^2)_k(M^3)_m(X^2)_n(X^3)_o.(H_2O)_p$, where $M^2$ is selected from a Group IA atom, Group IIA atom, Group IIIA atom, $M^3$ is selected from a Group IIA atom, Group IIIA, and a transition atom, $X^2$ is a hydroxyl anion, $X^3$ is a carbonate anion, k, m, n, and o are each independently integers that balance the charges of $M^2$, $M^3$, $X^2$, and $X^3$ and p is a number greater than or equal to 1. In some embodiments, $M^2$ is a Group IA atom comprising lithium, sodium, or potassium. In some embodiments, $M^2$ is a Group IIA atom comprising strontium, calcium, or magnesium. In some embodiments, $M^2$ is a Group IIIA metal cation such as aluminum ($Al^{+3}$). In a more specific embodiment, $M^2$ is magnesium. In an even more specific embodiment, $M^2$ is magnesium. In some embodiments, M3 is a Group IIA atom comprising strontium, calcium, or magnesium. In some embodiments, $M^3$ is a Group IIIA metal cation such as aluminum ($Al^{+3}$), and a transition metal cation such as iron ($Fe^{+3}$). In any case $M^2$ and $M^3$ will not be the same element.

Various anions can be used for $X^3$ in the hydrated salt, including but not limited to carbonate, and sulfate anions. Carbonate ions upon decomposition provide the additional benefit of releasing oxygen-diluting $CO_2$ in the aerosol combustion gases to further enhance fire suppression and facilitates the aerosolization of the fire suppressants such as potassium bromide. Examples of specific hydrated salts include hydromagnesite, dypingite, hydrotalcite, giorgiosite, protomagnesite, and artinite. The salts should be chosen to absorb energy (by release and vaporization of water from the hydrated salt structure) throughout the range of combustion temperatures, which can range from 250° C. to 500° C. For example, hydromagnesite demonstrates endothermic absorption of heat throughout the range of 300° C. through 560° C., with significant heat absorption occurring at 309° C., 446° C., and 554° C., with only a very small heat energy release at 516° C. The hydrated salts described herein can be used in as an alternative to or in combination with prior materials proposed for combustion heat/temperature management such as magnesium carbonate, hydrated magnesium oxalate, or ettringite.

The specific identity of hydrated mineral used and quantity would depend on the type and amount of fuel and oxidizer used and their ratio. For example, if a more efficient fuel were to be used generating more heat, one would either increase the amount of say hydromagnesite or use a higher hydrated mineral such as giorgiosite or a mixture of two or more acceptable hydrated minerals. In some embodiments, the hydrated water is present in the composition in an amount of about 10 wt. % to about 50 wt. % based on the total weight of the aerosol-generating composition. In some more specific embodiments, the hydrated salt is present in the composition in an amount of about 12 wt. % to about 45 wt. %, and even more specifically from about 15 wt. % to about 42 wt. %.

The aerosol compositions of the invention may further include a binder. The binder systems encompassed by the present invention should be chemically stable at storage temperatures, so that no reaction between the inorganic halogen component and the binder system will occur prior to use. Thus, the binder chosen for the binder system may include any such resin having a low flame temperature and heat of formation. The binder can in some cases also function as a fuel component, and some fuels (e.g., melamine) can become part of the binder by reacting into the binder matrix during cure.

Suitable binders include, but are not limited to, silicates, including alkali silicates, cellulose derivatives, cellulose ethers, alginic binders, gums, gels, pectins, starches, polyvinyl compounds or mixtures thereof. Examples of binders include, but are not limited to, hydrolyzed ethyl silicate; sodium silicate; potassium silicate; plasticized polyvinyl alcohol; polyvinyl butyral; polyvinyl acetate; cellulose derivatives, such as nitro cellulose, hydroxyethylethyl cellulose, hydroxypropyl cellulose, hydroxymethylethyl cellulose, sodium carboxymethyl cellulose, methyl cellulose, hydroxyethyl cellulose; hydroxypropyl cellulose, glycerine, polyvinyl pyrrolidone, ammonium alginate; sodium alginate; potassium alginate; magnesium alginate; triethanolamine alginate; propylene glycol alginate; gum Arabic; gum ghatti; gum tragacanth; Karaya gum; locust bean gum; acacia gum; guar gum; quince see gum; xanthan gum; agar; agarose; caragenneans; fucoidan; furecelleran or mixtures thereof. Other binders include, but are not limited to, carboxy-terminated polybutadiene (CTPB), polyethylene glycol (PEG), polypropylene glycol (PPG), hydroxy-terminated polybutadiene (HTPB), polybutadiene acrylonitrile (PBAN), polybutadiene acrylic acid (PBAA), butacene (HTPB iron adduct), glycidyl azide polymer (GAP), polyglycol adipate (PGA), or other thermoplastic polymers such as but not limited to polystyrene, polycarbonate, and polyvinylchloride, as well as compatible mixtures of any of the foregoingthereof.

The binder, when used, can be present in an amount from about 0.5 weight percent to about 20 weight percent of the composition. In another embodiment, the binder is present in an amount from about 1 weight percent to about 15 weight percent of the composition. In some embodiments, the binder is present in an amount from about 2 weight percent to about 10 weight percent of the composition. Polyols known to one of ordinary skill in the art may be added in addition to the binder to plasticize the binder material and increase the dry strength of the product. Examples of such polyols include, but are not limited glycerol and glycols, such as propylene glycol or polyethylene glycol. Typically, the polyols are present in an amount from about 0.5 weight percent to about 20 weight percent of the composition. In another embodiment, the polyol is present in an amount from about 4 weight percent to about 15 weight percent of the composition. In yet another embodiment, the polyol is present in an amount from about 8 weight percent to about 12 weight percent of the composition. In some embodiments, the polyol is present in an amount from about 2 weight percent to about 6 weight percent.

In some embodiments, the binder system is organic in nature and includes at least a binder or binder resin and a plasticizer, such as those described in U.S. Pat. No. 6,019,177, the entirety of which is incorporated herein by reference. The binder system can be in a solid form at a temperature below 100° C. The binder resin may include at least one of a curable binder, melt cast binder, or solvated binder, or a mixture thereof. The binder system may also include one or more of a curing or bonding agent, an antioxidant, an opacifier, or a halogen scavenger such as lithium carbonate. Curing agents suitable for use with the invention may include hexamethylene diisocyanate (HMDI), isophorone diisocyanate (IPDI), toluene diisocyanate (TDI), trimethylxylene diisocyanate (TMDI), dimeryl diisocyanate (DDI), diphenylmethane diisocyanate (MDI), naphthalene diisocyanate (NDI), dianisidine diisocyanate (DADI), phenylene diisocyanate (PDI), xylene diisocyanate (MXDI), other diisocyanates, triisocyanates, higher isocyanates than the triisocyanates, polyfunctional isocyanates, or a mixture thereof. The amount of the curing agent needed is generally determined by the desired stoichiometry between the curable binder and the curing agent. The curing agent is typically present in an amount of up to about 5 percent. However, if a curable binder is used, the curing agent is present from about 0.5 percent to about 5 percent.

Other additives can be included as well, as known in the art, including but not limited to cure catalysts (e.g., butyl tin dilaurate, a metal acetylacetonate), antioxidants (e.g., 2,2'-bis(4-methyl-6-t-butylphenol)), corrosion inhibitors, extrusion lubricants, or solid coolants. An opacifier such as carbon black can aid in providing uniform heat transfer and reducing possible areas of select heat build-up. It also functions as a UV obscurant to help mitigate radiant UV transmission emitting from the burn front into the unburned composition. Exemplary levels for opacifiers can range from 0.01 wt. % to 2 wt. % based on the total solids of the combustible composition.

The combustible flame suppressant aerosol-generating composition can be prepared by blending the above-described components, i.e., oxidizer, fuel, binder or components thereof, e.g., polyfunctional resin and polyfunctional curing agent), hydrated salt, and any additional or optional components in a mixing vessel. During the working time of the composition, the mixture can be molded into a desired shape or extruded and pelletized. The presence in the composition of materials that will release moisture at relatively low temperatures, e.g., below 180° C. can cause the composition to burn poorly, inconsistent and or not function at all, particularly at temperature extremes (−40° F. and +160° F.). Accordingly, in some embodiments, such materials that can retain water and release it at temperatures below 180° C. (e.g., potassium cyanurate and bromate) are dried such as by heating to temperatures of 180° C. In some embodiments, particle sizes of the various ingredients before blending are selected to help contribute to beneficial burn rate profiles and other characteristics. Exemplary particle sizes for the oxidizer (e.g., $KBrO_3$) and fuel (e.g., potassium cyanurate) can range from 1 μm to 100 μm, more specifically from 1 μm to 50 μm, and even more specifically from 1 μm to 30 μm. Exemplary particle sizes for the hydrated salts (e.g. hydromagnesite) can range be less than 100 μm, more specifically less than 40 μm, and even more specifically less than 10 μm. After cure the composition is complete, the solid combustible aerosol-generating composition can be fitted into an aerosol-generating module. An exemplary aerosol module is schematically depicted in the FIGURE, where aerosol module 10 has a housing or vessel 12 with a solid aerosol-generating composition 14 therein. Upon activation of combustion by ignition device 16 (e.g., an electronic ignition device), combustion of the aerosol composition 14 produces combustion gases and particulates 18 that are exhausted as an aerosol through opening 19.

The pyrotechnic aerosol fire suppression compositions have other uses as well, including but not limited to smoke grenades, colored signal devices, smoke tracers, agent dispersal compositions, and air current tracer devices of low incendiary potential. The dense, opaque, nontoxic smoke produced, which is transparent to infrared vision devices, provides for utility in crowd control or hostage situations encountered by law enforcement. In addition, the pyrotechnic aerosol fire suppression compositions may also be used as an expulsion charge for items, such as infrared flares and other types of flares. The low reaction temperatures and lack of flash can aid in concealing the combustion source from observation. Further, the compositions of the present invention may be used in finely granulated form to generate gas to fill air bags, particularly where low temperatures are required to avoid damage to the air bag itself.

The invention is further described in the following Examples set forth below.

Example 1

About 100 grams of 98%+ of powdered potassium bromate (Spectrum Chemical Mfg. Corporation) are prepared by reduce particle size between 1μ and 30μ using a ball jar mill/burundum apparatus or equivalent. A homogenous combination is prepared of about 25.0 grams of anhydrous powdered (between 1μ and 30μ as described above), potassium cyanurate (manufactured using methods described in U.S. Pat. No. 7,728,132, U.S. Pat. No. 8,067,587 or though commercial source), about 20 grams of powdered (under 10) hydromagnesite (Minelco Limited), and about 2 grams of carbon black (Monarch 1400, Cabot Corporation or equivalent). The powdered potassium bromate is added to the above potassium cyanurate/hydromagnesite/carbon black combination and mixed until homogenous. The resultant homogenous mixture can be used directly as is or compressed into a vessel for use as a pyrotechnic aerosol fire suppressant.

Example 2

A slurry is formed by combining about 100 grams of the final composition prepared in Example 1 and about 2 to 4 grams of a thermoplastic polymer such as polysulfone using an appropriate anhydrous solvent such as cyclohexanone. Once mixed homogenously the composition is placed in a dismountable mold or discharge vessel, allowing the solvent to completely evaporate, thereby having the hardened composition available for use as a pyrotechnic aerosol fire suppressant unit.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustible fire-suppressant aerosol composition, comprising:

an oxidizer represented by the formula $M^1(X^1O_y)_z$, wherein $M^1$ is selected from a Group IA atom, a Group IIA atom, and a Group IIIA atom, X is selected from the group consisting of Cl, Br and I, y is 1-4, and z is 1-3;

a fuel; and a hydrated salt having a dehydration decomposition temperature greater than 200° C., represented by the formula $(M^2)_k(M^3)_m(X^2)_n(X^3)_o.(H_2O)_p$ where $M^2$ is selected from a Group IA atom, Group IIA atom, Group IIIA atom, $M^3$ is selected from a Group IIA atom, Group IIIA, and a transition atom, $X^2$ is a hydroxyl anion, $X^3$ is a carbonate or sulfate anion, k, m, n, and o are each independently integers that balance the charges of $M^2$, $M^3$, $X^2$, and $X^3$ and p is a number greater than or equal to 1.

2. The composition of claim 1, wherein the hydrated salt has a dehydration decomposition temperature greater than 260° C.

3. The composition of claim 2, wherein the hydrated salt has a dehydration decomposition temperature greater than 260° C. and less than 600° C.

4. The composition of claim 1, wherein p is a number of 1 to 40.

5. The composition of claim 4, wherein p is a number of 1 to 20.

6. The composition of claim 1, wherein $M^2$ and $M^3$ are each independently selected from magnesium, calcium, aluminum, and iron cations.

7. The composition of claim 1, wherein hydrated salt comprises artinite, hydrotalcite, hydromagnesite, dypingite, giorgiosite, and protomagnesite or mixtures thereof.

8. The composition of claim 1, wherein $M^1$ is lithium, potassium, sodium, strontium, magnesium, or aluminum, and $X^1O_y$ is chlorate, bromate, iodate, perchlorate, and or chlorite.

9. The composition of claim 1, wherein the oxidizer comprises sodium bromate, potassium bromate, or a mixture thereof.

10. The composition of claim 1, wherein the fuel comprises melamine cyanurate, potassium cyanurate, potassium isocyanurate, potassium hydroxyacetate, magnesium cyanurate, magnesium isocyanurate, magnesium hydroxyacetate, or a mixture comprising one or more of the foregoing.

11. The composition of claim 1, wherein the weight ratio of the oxidizer to the fuel is from 3:2 to 10:1.

12. The composition of claim 1, comprising from 45 wt. % to 90 wt. % of the oxidizer, from 7 wt. % to 40 wt. % of the fuel, and from 12 wt. % to 45 wt. % of the hydrated salt.

13. The composition of claim 1, comprising from 57 wt. % to 86 wt. % of the oxidizer, from 10 wt. % to 30 wt. % of the fuel, and from 15 wt. % to 42 wt. % of the hydrated salt.

14. A method of discharging an aerosol flame suppressant, comprising:

combusting, in an enclosed vessel comprising at least one discharge opening, a composition comprising an oxidizer represented by the formula $M^1(X^1O_y)_z$, wherein $M^1$ is selected from a Group IA atom, a Group IIA atom, and a Group IIIA atom, X is selected from the group consisting of Cl, Br and I, y is 1-4, and z is 1-3, a fuel, and a hydrated salt having a dehydration decomposition temperature greater than 200° C., represented by the formula $(M^2)_k(M^3)_m(X^2)_n(X^3)_o.(H_2O)_p$ where $M^2$ is selected from a Group IA atom, Group IIA atom, Group IIIA atom, $M^3$ is selected from a Group IIA atom, Group IIIA, and a transition atom, $X^2$ is a hydroxyl anion, $X^3$ is a carbonate or sulfate anion, k, m, n, and o are each independently integers that balance the charges of $M^2$, $M^3$, $X^2$, and $X^3$ and p is a number greater than or equal to 1; and discharging combustion products produced by combustion of the composition as an aerosol through the discharge opening.

15. The method of claim 14, wherein at least a portion of the combustion of the composition occurs at a temperature of 260° C. to 538° C.

* * * * *